US008312862B2

(12) United States Patent
Klesse et al.

(10) Patent No.: US 8,312,862 B2
(45) Date of Patent: Nov. 20, 2012

(54) INJECTION SYSTEM FOR AN INTERNAL COMBUSTION ENGINE

(75) Inventors: Christoph Klesse, Wörth A.D.Donau (DE); Uwe Lingener, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 361 days.

(21) Appl. No.: 12/674,464

(22) PCT Filed: Aug. 1, 2008

(86) PCT No.: PCT/EP2008/060182

§ 371 (c)(1),
(2), (4) Date: Feb. 22, 2010

(87) PCT Pub. No.: WO2009/024447

PCT Pub. Date: Feb. 26, 2009

(65) Prior Publication Data

US 2011/0126805 A1 Jun. 2, 2011

(30) Foreign Application Priority Data

Aug. 23, 2007 (DE) ..... 10 2007 039 892

(51) Int. Cl.
*F02M 57/02* (2006.01)
*F02M 63/00* (2006.01)

(52) U.S. Cl. ..... 123/446; 123/447; 123/458; 123/511

(58) Field of Classification Search ..... 123/446, 123/447, 448–452, 455, 456, 457, 458, 461, 123/464, 510, 511
See application file for complete search history.

(56) References Cited

U.S. PATENT DOCUMENTS 4,801,247 A * 1/1989 Hashimoto et al. ..... 417/213
5,546,912 A 8/1996 Yamada et al. ..... 123/511
5,884,597 A * 3/1999 Hiraku et al. ..... 123/179.17
6,058,912 A * 5/2000 Rembold et al. ..... 123/516
6,293,251 B1 * 9/2001 Hemmerlein et al. ..... 123/447
(Continued)

FOREIGN PATENT DOCUMENTS

DE 10118884 A1 11/2002
(Continued)

OTHER PUBLICATIONS

German Office Action, German application No. 10 2007 039 892.3-13, 6 pages, Mar. 20, 2008.
(Continued)

*Primary Examiner* — Thomas Moulis
(74) *Attorney, Agent, or Firm* — King & Spalding L.L.P.

(57) ABSTRACT

An injection system for an internal combustion engine has a prefeed pump for feeding fuel from a fuel tank, a high-pressure pump, which is situated downstream of the prefeed pump, for feeding the fuel into at least two injectors, a fuel distributor which is situated downstream of the high-pressure pump and which is designed to distribute the fuel to the injectors, a pressure control or pressure limiting valve situated downstream of the high-pressure pump and by which the pressure to be produced in the fuel distributor can be adjusted or limited, and a pressure sensor for determining a pressure downstream of the high-pressure pump and upstream of the pressure control or pressure limiting valve, wherein the pressure sensor, the pressure control or pressure limiting valve and the fuel distributor are formed in a high-pressure module, and the high-pressure module is formed as a structural unit with the high-pressure pump.

9 Claims, 2 Drawing Sheets

U.S. PATENT DOCUMENTS

| | | | | |
|---|---|---|---|---|
| 6,314,946 | B1 | 11/2001 | Funakura et al. | 123/509 |
| 6,405,711 | B1 | 6/2002 | Smith et al. | 123/456 |
| 6,827,065 | B2 | 12/2004 | Gottemoller et al. | 123/456 |
| 6,848,423 | B2 | 2/2005 | Schmidle et al. | 123/446 |
| 7,299,790 | B2 * | 11/2007 | Okamoto et al. | 123/506 |
| 7,513,240 | B2 * | 4/2009 | Usui et al. | 123/467 |
| 7,774,125 | B2 * | 8/2010 | Scharfenberg | 701/103 |
| 8,042,520 | B2 * | 10/2011 | Miller et al. | 123/458 |
| 8,100,109 | B2 * | 1/2012 | Nakata | 123/446 |
| 2002/0092504 | A1 * | 7/2002 | Kohketsu et al. | 123/447 |
| 2002/0092505 | A1 * | 7/2002 | Rembold et al. | 123/464 |
| 2003/0047169 | A1 * | 3/2003 | Buse et al. | 123/457 |
| 2004/0007214 | A1 | 1/2004 | Schmidl et al. | 123/514 |
| 2004/0045537 | A1 | 3/2004 | Simon et al. | 123/495 |
| 2004/0118764 | A1 * | 6/2004 | Miller et al. | 210/258 |
| 2004/0200457 | A1 | 10/2004 | Gottemoller et al. | 123/468 |
| 2005/0175488 | A1 * | 8/2005 | Schelhas et al. | 417/505 |
| 2005/0188958 | A1 * | 9/2005 | Klenk et al. | 123/458 |
| 2005/0257775 | A1 * | 11/2005 | Kojima | 123/458 |
| 2006/0147317 | A1 * | 7/2006 | Okamoto et al. | 417/297 |
| 2006/0157032 | A1 * | 7/2006 | Hori | 123/458 |
| 2007/0101973 | A1 * | 5/2007 | Wolber et al. | 123/464 |
| 2007/0102543 | A1 | 5/2007 | Gibson et al. | 239/533.4 |
| 2007/0261675 | A1 * | 11/2007 | Akita et al. | 123/445 |
| 2008/0236554 | A1 | 10/2008 | Rapp et al. | 123/672 |
| 2008/0294327 | A1 * | 11/2008 | Oono | 701/104 |
| 2009/0250038 | A1 * | 10/2009 | Xu et al. | 123/457 |
| 2010/0036585 | A1 * | 2/2010 | Scharfenberg | 701/103 |
| 2010/0047084 | A1 | 2/2010 | Hokkanen | 417/213 |
| 2010/0082223 | A1 * | 4/2010 | Toyohara et al. | 701/103 |
| 2012/0080010 | A1 * | 4/2012 | Nistler et al. | 123/456 |

FOREIGN PATENT DOCUMENTS

| | | | |
|---|---|---|---|
| DE | 10360334 | A1 | 7/2005 |
| DE | 102004015266 | A1 | 10/2005 |
| DE | 102006000335 | A1 | 1/2007 |
| DE | 102005040918 | A1 | 3/2007 |
| DE | 102005059828 | A1 | 6/2007 |
| EP | 0892170 | A1 | 1/1999 |
| EP | 1296060 | | 3/2003 |
| EP | 1361359 | A1 | 11/2003 |
| EP | 1469188 | A1 | 10/2004 |
| JP | 11294292 | A | 10/1999 |
| WO | 01/33070 | A1 | 5/2001 |
| WO | 2008/057032 | A1 | 5/2008 |
| WO | 2009/024447 | A1 | 2/2009 |

OTHER PUBLICATIONS

International PCT Search Report, PCT/EP2008/060182, 7 pages, Dec. 9, 2008.

* cited by examiner

INJECTION SYSTEM FOR AN INTERNAL COMBUSTION ENGINE

CROSS-REFERENCE TO RELATED APPLICATIONS

This application is a U.S. National Stage Application of International Application No. PCT/EP2008/060182 filed Aug. 1, 2008, which designates the United States of America, and claims priority to German Application No. 10 2007 039 892.3 filed Aug. 23, 2007, the contents of which are hereby incorporated by reference in their entirety.

TECHNICAL FIELD

The invention relates to an injection system for an internal combustion engine.

BACKGROUND

For the purpose of supplying fuel to the combustion chambers of an internal combustion engine, in particular a diesel fuel internal combustion engine, injection systems are used which in recent years have increasingly been implemented in the form of so-called "common rail" systems. In these systems, the injectors—which are disposed in the combustion chambers—are supplied with fuel from a common fuel accumulator, the common rail. The fuel to be injected is held in said fuel accumulator under a pressure of up to 2000 bar.

Injection systems for internal combustion engines usually have different pumps by means of which fuel is conveyed in order to reach the combustion chambers of the internal combustion engine. Such injection systems for internal combustion engines place high demands on the accuracy of the injection pressure required to inject fuel into the combustion chambers of the internal combustion engine.

This is particularly important since the regulations being enacted with regard to permissible levels of harmful emissions from internal combustion engines in motor vehicles are becoming increasingly stringent. This means it is necessary to carry out various measures to reduce harmful emissions. Thus, for example, the formation of soot is heavily dependent on the preparation of the air/fuel mix in the respective cylinder of the internal combustion engine.

With suitable control and regulating units, the injection system may achieve a highly accurate fuel injection pressure in the combustion chambers of the internal combustion engine.

An injection system for an internal combustion engine is known from EP 1 296 060 B1, said injection system having a prefeed pump, with which fuel may be conveyed from a fuel tank to the suction side of a high-pressure pump. A hydraulic high-pressure pump connected downstream from the prefeed pump then conveys fuel into a fuel accumulator, from whence it may then be distributed to injectors hydraulically coupled to the fuel accumulator.

SUMMARY

According to various embodiments, an injection system of the type described in the introduction can be provided, which enables the injection system to be constructed simply and at low cost.

According to an embodiment, an injection system for an internal combustion engine, may comprise a prefeed pump for feeding fuel from a fuel tank, a high-pressure pump disposed downstream from the prefeed pump, for feeding the fuel into at least two injectors, a fuel distributor disposed downstream from the high-pressure pump, which is designed to distribute the fuel to the injectors, a pressure control or pressure limiting valve disposed downstream from the high-pressure pump, with which the pressure to be produced in the fuel distributor can be adjusted or limited, and a pressure sensor for determining a pressure downstream from the high-pressure pump and upstream from the pressure control or pressure limiting valve, wherein the pressure sensor, the pressure control or pressure limiting valve and the fuel distributor are formed in a high-pressure module, and the high-pressure module is formed as a structural unit with the high-pressure pump.

According to a further embodiment, a temperature sensor can be formed in the high-pressure module for determining a temperature of the fuel downstream from the high-pressure pump and upstream from the pressure control or pressure limiting valve. According to a further embodiment, a first hydraulic resistance element can be disposed downstream from the fuel distributor and upstream from the injectors in the high-pressure module. According to a further embodiment, a fuel accumulator formed in the high-pressure module can be disposed downstream from the pressure control or pressure limiting valve, said fuel accumulator being hydraulically coupled to a leakage drain of the injectors. According to a further embodiment, an additional hydraulic resistance element can be hydraulically disposed in the high-pressure module between the leakage drain and the fuel accumulator. According to a further embodiment, the high-pressure module can be designed as a structural unit with the prefeed pump.

BRIEF DESCRIPTION OF THE DRAWINGS

Exemplary embodiments are explained below on the basis of schematic drawings.

In these.

Elements having the same construction or function are labeled with the same reference characters across all the diagrams.

DETAILED DESCRIPTION

Figure 1:
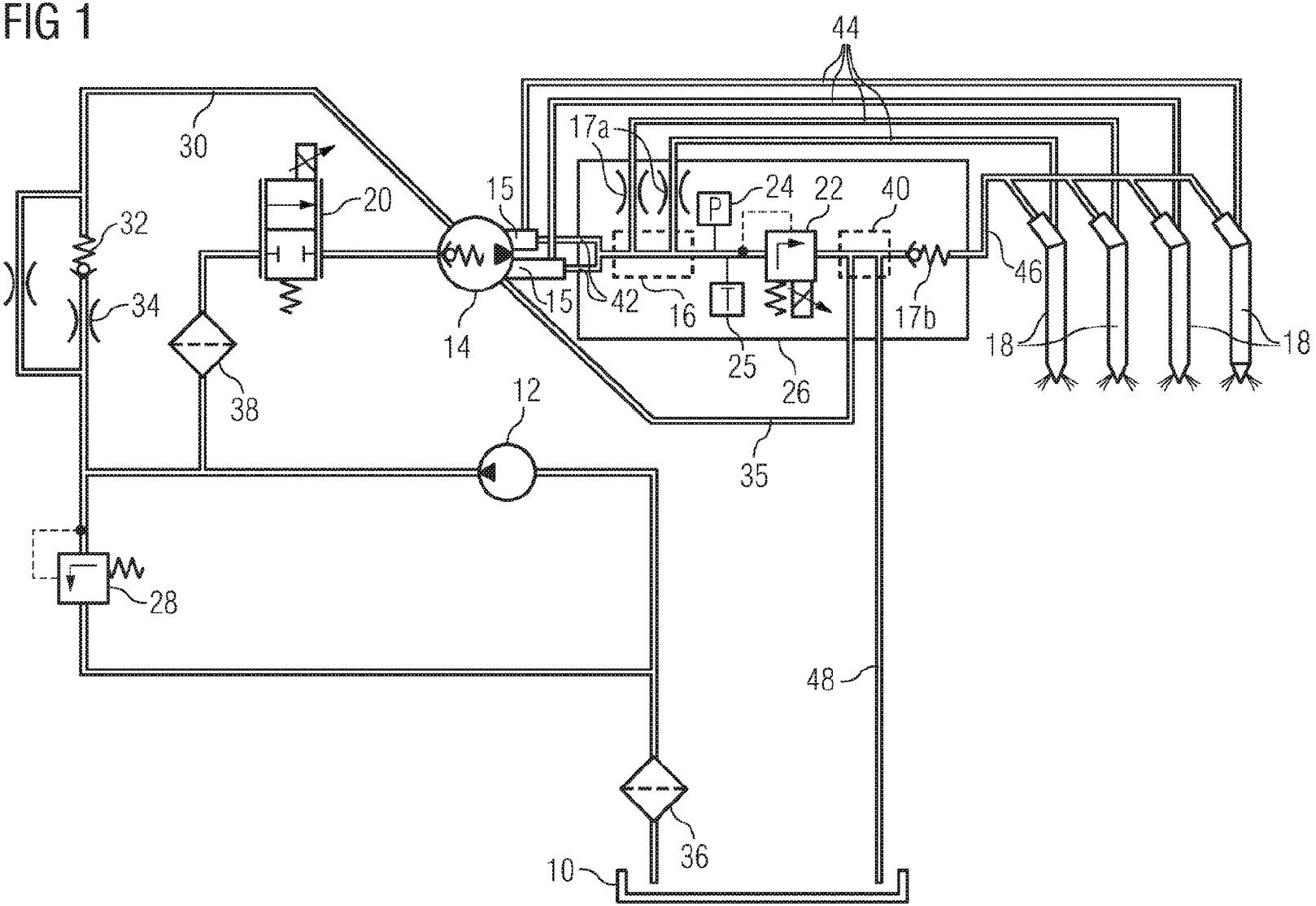
FIG. 1 is a block diagram of an injection system for an internal combustion engine.

According to various embodiments, an injection system for an internal combustion engine may have a prefeed pump for feeding fuel from a fuel tank, a high-pressure pump which is situated downstream from the prefeed pump for feeding the fuel into at least two injectors, a fuel distributor which is situated downstream from the high-pressure pump, and which is designed to distribute the fuel to the injectors, a pressure control or pressure limiting valve which is situated downstream from the high-pressure pump, and by means of which the pressure to be produced in the fuel distributor can be adjusted or limited, and a pressure sensor for determining a pressure downstream from the high-pressure pump and upstream from the pressure control or pressure limiting valve, wherein the pressure sensor, the pressure control or pressure limiting valve and the fuel distributor are formed in a high-pressure module, and the high-pressure module is formed as a structural unit with the high-pressure pump. The high-pressure module has a structural unit comprising the pressure sensor, the pressure control or pressure limiting valve and the fuel distributor.

This is advantageous since it dispenses with the need for a common rail. The high-pressure conveyance may be implemented outside the high-pressure pump, so that high pressure is possible in the injection system. The pump housing can therefore be constructed as a non-high-pressure-resistant pump housing. Consequently it is possible to use a low-cost, lightweight material (aluminum or plastic) for the pump housing. Furthermore, it is possible for the entire high-pressure module comprising the pressure sensor, the pressure control or pressure limiting valve and the fuel distributor to be replaced without the need for modifications to the high-pressure pump. The advantage of designing the high-pressure module as a structural unit with the high-pressure pump is that the pressure sensor disposed in the high-pressure module, because of its proximity to the high-pressure pump, can easily be used to diagnose the function of the high-pressure pump. Furthermore, it is possible for a mechanically stable structural unit to be implemented from the high-pressure pump and high-pressure module.

In an embodiment, a temperature sensor is formed in the high-pressure module to determine a temperature of the fuel downstream from the high-pressure pump and upstream from the pressure control or pressure limiting valve. This has the advantage that the high-pressure module can be designed with an additional function, namely measurement of the temperature of the fuel.

In a further embodiment, a first hydraulic resistance element is disposed downstream from the fuel distributor and upstream from the injectors in the high-pressure module. This makes it possible for hydraulic resistance elements, which can be used to attenuate hydraulic pressure oscillations, to be easily integrated into the high-pressure module.

In a further embodiment, a fuel accumulator formed in the high-pressure module is disposed downstream from the pressure control or pressure limiting valve, said fuel accumulator being hydraulically coupled to a leakage drain of the injectors. This has the advantage that fuel leaking from the injectors and flowing through the pressure control or pressure limiting valve can be collected in the fuel accumulator disposed in the high-pressure module and then fed back to the fuel tank via a common pipe which may lead off from the high-pressure module.

In a further embodiment, a further hydraulic resistance element is disposed in the high-pressure module between the leakage drain and the fuel accumulator. This makes it possible for additional hydraulic resistance elements, which may be used for setting the injector leakage counter-pressure of the individual injectors, to be easily integrated into the high-pressure module. Furthermore, the injector leakage counter-pressure can be very precisely controlled by the additional hydraulic resistance element. This makes it possible for the production tolerances of the injector to be increased.

In a further embodiment the high-pressure module is formed as a structural unit with the prefeed pump. This has the advantage that the high-pressure module may be used as a limiting element or cover for the prefeed pump. Furthermore, owing to the proximity of the high-pressure sensor to the prefeed pump, the measurement signal of the high-pressure sensor can easily be used for diagnosing the function of the prefeed pump.

The diagrams show an injection system for an internal combustion engine, comprising a fuel tank 10 from which fuel is fed by means of a prefeed pump 12. The prefeed pump 12 may be mechanically driven by a drive shaft 13, wherein said drive shaft 13 may be permanently coupled to a motor shaft of the internal combustion engine. Alternatively, it is also possible for the prefeed pump 12 to be operated electrically, whereby the delivery rate of the prefeed pump 12 may be controlled independently of the delivery rate of further pumps.

The prefeed pump 12 is hydraulically coupled on the output side with an inlet pressure control valve 28, which delivers part of the fuel fed by the prefeed pump 12 back to the suction side of the prefeed pump 12 when a predefined fuel pressure is exceeded on the output side of the prefeed pump 12, and thus keeps the fuel pressure on the output side of the prefeed pump 12 at a largely constant level.

A high-pressure pump 14 with preferably two pump cylinders 15 is disposed downstream from the prefeed pump 12. The high-pressure pump 14 may preferably also have an individual pump cylinder 15. The high-pressure pump 14 may preferably be designed as a radial piston pump or as an in-line piston pump with a plurality of pump cylinders 15, as disclosed for use in injection systems of internal combustion engines.

The high-pressure pump 14 feeds fuel via connecting lines 42 and injector feed lines 44 into a fuel distributor 16 disposed downstream from the high-pressure pump 14 and into injectors 18 disposed downstream from the high-pressure pump 14 and/or the fuel distributor 16.

Each of the injectors 18 is assigned to a combustion chamber of the internal combustion engine and each of the injectors 18 can be controlled such that fuel is injected into the combustion chamber. The leakage from the injectors 18 may be delivered back to the fuel tank 10 via a leakage drain 46.

To control the injection pressure, the injection system has a pressure control or pressure limiting valve 22 downstream from the high-pressure pump 14, said pressure control or pressure limiting valve being electrically and mechanically coupled to a pressure sensor 24. The pressure sensor 24 is hydraulically disposed between the high-pressure pump 14 and the pressure control or pressure limiting valve 22, preferably in the vicinity of the fuel distributor 16. The fuel pressure downstream from the high-pressure pump 14 is measured via the pressure sensor 24. The pressure control or pressure limiting valve 22 is set according to the measured fuel pressure. When a predefined fuel pressure is exceeded the pressure control or pressure limiting valve 22 opens, and part of the fuel fed by the high-pressure pump 14 may be fed back via into the fuel tank 10 via a fuel accumulator 40 and a fuel return line 48 disposed downstream from the fuel accumulator 40.

A volume flow control valve 20 is further disposed between the prefeed pump 12 and the high-pressure pump 14, said volume flow control valve enabling the fuel flow that is to be delivered to the high-pressure pump 14, to be controlled on the low-pressure side. To this end, the volume flow control valve 20 can be controlled according to the fuel pressure measured by means of the pressure sensor 24 and according to further input values.

First hydraulic resistance elements 17*a* are disposed downstream from the fuel distributor 16 and upstream from the injectors 18 respectively. The first hydraulic resistance elements 17*a* are preferably designed as throttles.

A further hydraulic resistance element 17*b* is hydraulically disposed between the leakage drain 46 and the fuel accumulator 40 in the high-pressure module 26. The control of the leakage counter-pressure via the leakage drain 46 can be very precisely set by the additional hydraulic resistance element 17*b*, whereby it possible for the production tolerances of the injectors 18 to be increased.

A temperature sensor 25 is disposed downstream from the high-pressure pump 14 and upstream from the pressure control or pressure limiting valve 22, said temperature sensor being used to determine a temperature of the fuel before the fuel enters the injectors 18. This enables the fuel temperature to be determined with particular precision immediately before the fuel enters the injectors 18.

In a further embodiment the temperature sensor can also be hydraulically disposed between the injectors 18 and the additional hydraulic resistance element 17*b* or downstream from the additional hydraulic resistance element 17*b* in the high-pressure module 26.

In the embodiment of the injection system shown here, the fuel distributor 16, the hydraulic resistance elements 17*a*, 17*b*, the pressure control or pressure limiting valve 22, the pressure sensor 24, the temperature sensor 25 and the fuel accumulator 40 are designed as a high-pressure module 26. Said high-pressure module 26 forms a structural unit, comprising at least the fuel distributor 16, the pressure sensor 24 and the pressure control or pressure limiting valve 22. The high-pressure module 26 is preferably formed from a block made out of a high-pressure-resistant steel, in which holes are bored for the fuel distributor 16, the hydraulic resistance elements 17*a*, 17*b*, the pressure control or pressure limiting valve 22, the pressure sensor 24, the temperature sensor 25 and the fuel accumulator 40. This means that the high-pressure module 26 is very easy to manufacture.

The measurement and control or regulation of pressure is further optimized by the arrangement of the fuel distributor 16, the pressure control or pressure limiting valve 22, and the pressure sensor 24 in the high-pressure module 26. The pressure is registered by the pressure sensor 24 directly at the place where it is to be controlled by the pressure control or pressure limiting valve 22.

In further embodiments of the injection system the hydraulic resistance elements 17*a*, 17*b*, the temperature sensor 25 and the fuel accumulator 40 may be formed in the high-pressure module 26 individually or in any combination with one another.

A scavenging line 30, which opens on the output end into the housing of the high-pressure pump 14, branches off between the prefeed pump 12 and the inlet pressure control valve 28. This means that the housing of the high-pressure pump 14 can be flushed during operation of the high-pressure pump 14, thus enabling the high-pressure pump 14 to be cooled and lubricated.

A scavenging line valve 32, with a scavenging line throttle 34 hydraulically connected to it in series, is disposed in the scavenging line 30. The scavenging line throttle 34 is used for limiting the fuel flow diverted into the scavenging line 30 for flushing purposes. The scavenging line valve 32 is arranged such that it does not release the fuel flowing via the scavenging line 30 until a prescribed fuel pressure is exceeded on the output side of the prefeed pump 12. The opening pressure on the scavenging line valve 32 must in this case be greater than the opening pressure on the inlet valves (not shown) on the high-pressure pump 14 and the line located between them. This is the only way to ensure that the high-pressure pump 14 is not flushed unless the operating pressure of the high-pressure pump 14 is reached. This ensures that the buildup of pressure on the suction side of the high-pressure pump 14 is not delayed.

The fuel used for flushing purposes may exit the high-pressure pump 14 via a scavenger return line 35 and be fed back to the fuel tank 10 via the fuel accumulator 40 and the fuel return line 48.

To protect against particles brought in with the fuel flow or for filtration of water, one or more filters 36, 38 are preferably disposed before the prefeed pump 12 and the volume flow control valve 20. Thus a first filter 36 is provided hydraulically between the fuel tank 10 and the prefeed pump 12 to protect the prefeed pump 12. Furthermore, a second filter 38 is disposed before the volume flow control valve 20 to protect the volume flow control valve 20 and the high-pressure pump 14.

The line downstream from the pressure control or pressure limiting valve 22 is hydraulically coupled to the scavenger return line 35 and the leakage drain 46 of at least one injector 18. The scavenger return line 35, the line downstream from the pressure control or pressure limiting valve 22 and die injector return line 46 from the injectors 18 are brought together in the fuel accumulator 40 and routed back hydraulically via the fuel return line 48 preferably to the fuel tank 10.

The high-pressure module 26 is preferably implemented directly in a structural unit with the high-pressure pump 14. This enables the number of hydraulic and electrical interfaces to be further reduced, which means that the installation cost for the injection system can also be further reduced. Moreover, implementing the fuel distributor 16, pressure control or pressure limiting valve 22, pressure sensor 24 and high-pressure pump 14 in a structural unit enables additional material savings to be made. Thus a further cost saving can be achieved overall.

It is particularly preferable if the high-pressure module 26 is implemented in a structural unit with the prefeed pump 12. In this case the high-pressure module 26 may be used as a limiting element or as a cover for the prefeed pump 12. Owing to the proximity of the pressure sensor 24 to the prefeed pump 12, the measurement signal of the high-pressure sensor 24 can easily be used for diagnosing the function of the prefeed pump 12.

Figure 2A:
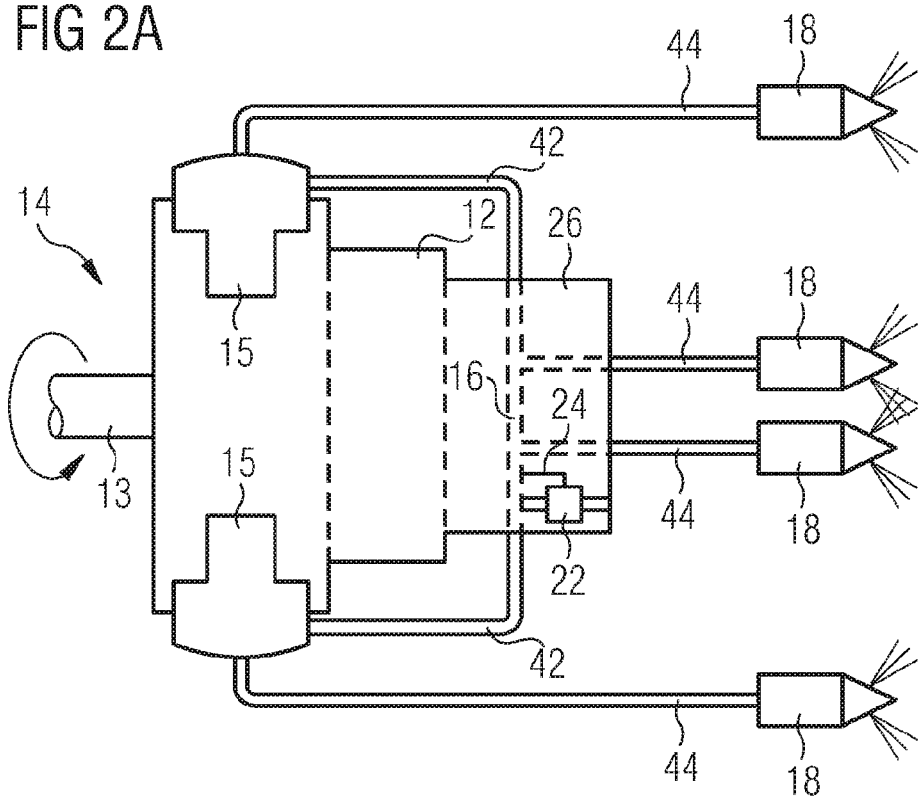
FIG. 2*a* is a block diagram of a first embodiment of the injection system.

FIG. 2*a* shows a part of the injection system for an internal combustion engine, illustrated with four injectors 18 and four injector feed lines 44. Two of the injectors 18 are each hydraulically coupled via one of the injector feed lines 44 to one of the pump cylinders 15 of the high-pressure pump 14. Two further injectors 18 are each hydraulically coupled via one of the injector feed lines 44 hydraulically to the fuel distributor 16 in the high-pressure module 26. The fuel distributor 16 is in turn hydraulically coupled via the two connecting lines 42 to the two pump cylinders 15 of the high-pressure pump 14. The high-pressure pump 14, the prefeed pump 12 and the high-pressure module 26 form a structural unit.

Figure 2B:
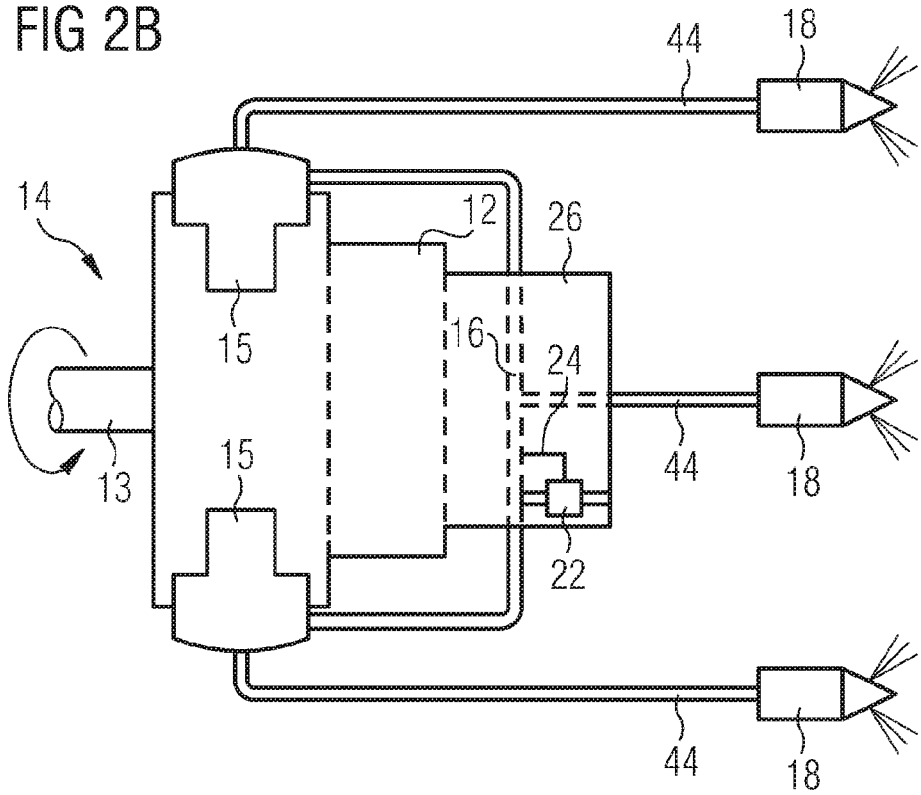
FIG. 2*b* is a block diagram of a second embodiment of the injection system.

FIG. 2*b* shows a second embodiment of the injection system. Unlike in the first embodiment of the injection system as per FIG. 2*a*, an injection system with three injectors 18 is described here. This embodiment differs from the first embodiment in that here only one of the injectors 18 is hydraulically coupled via one of the injector feed lines 44 to the fuel distributor 16 in the high-pressure module 26.

The function of the injection system is described briefly below:

The prefeed pump 12 feeds fuel from the fuel tank 10, wherein the interposed first filter 36 can clean the fuel of particle contamination and free water content, to prevent wear and corrosion in the injection system. The pressure of the fuel to be fed to the high-pressure pump 14 is limited by means of the inlet pressure control valve 28. The prefeed pump 12 delivers the fuel via the second filter 38 to the volume flow control valve 20, where the fuel volume flow may be set for the suction side of the high-pressure pump 14.

The high-pressure pump 14 delivers the required quantity of fuel for the injectors 18 via the injector feed line 44 and the fuel distributor 16. The pressure required for said fuel distributor 16 may be predefined on the high-pressure module 26 comprising fuel distributor 16, pressure control or pressure limiting valve 22 and pressure sensor 24. Said pressure control or pressure limiting valve 22 opens sufficiently wide to enable the predefined pressure on the pressure sensor 24 to be maintained. The fuel that was released via the pressure control or pressure limiting valve 22 flows via the fuel return line 48 and into the fuel accumulator 40, together with the fuel from the scavenger return line 35 and the fuel flowing out of the injectors 18 via the leakage drain 46, back into the fuel tank 10.

By forming the actuators and sensors provided for control and regulation in the high-pressure module 26, high-pressure fuel feed outside the high-pressure pump 14 can be achieved. The housing of the high-pressure pump 14 can thus be designed in a non-high-pressure-resistant form, since it enables the pump cylinders 15 alone to be designed as a high-pressure-loaded component. Consequently, a lightweight and low-cost material (preferably aluminum or plastic) can be used for the housing of the high-pressure pump 14. This further dispenses with the need for a common rail, since the fuel distributor 16 of the high-pressure module 26 already assumes the distribution function for the fuel. The simple construction of the high-pressure module 26 enables the injection system to be operated with a very high pressure. Furthermore, it is possible for the high-pressure module 26 to be completely replaced without the need for modifications to the high-pressure pump 14.

What is claimed is:

1. An injection system for an internal combustion engine, comprising:

a prefeed pump for feeding fuel from a fuel tank, a high-pressure pump disposed downstream from the prefeed pump, for feeding the fuel into at least two injectors, a fuel distributor disposed downstream from the high-pressure pump, which is designed to distribute the fuel to the injectors, a pressure control or pressure limiting valve disposed downstream from the high-pressure pump, with which the pressure to be produced in the fuel distributor can be adjusted or limited, a pressure sensor for determining a pressure downstream from the high-pressure pump and upstream from the pressure control or pressure limiting valve, wherein the pressure sensor, the pressure control or pressure limiting valve and the fuel distributor are formed in a high-pressure module, and the high-pressure module is formed as a structural unit with the high-pressure pump, and at least one of:

(a) a temperature sensor formed in the high-pressure module for determining a temperature of the fuel downstream from the high-pressure pump and upstream from the pressure control or pressure limiting valve, (b) a first hydraulic resistance element disposed downstream from the fuel distributor and upstream from the injectors in the high-pressure module, and (c) a fuel accumulator formed in the high-pressure module is disposed downstream from the pressure control or pressure limiting valve, said fuel accumulator being hydraulically coupled to a leakage drain of the injectors.

2. The injection system according to claim 1, wherein an additional hydraulic resistance element is hydraulically disposed in the high-pressure module between the leakage drain and the fuel accumulator.

3. The injection system according to claim 1, wherein the high-pressure module is designed as a structural unit with the prefeed pump.

4. A method for injecting fuel in an internal combustion engine, comprising the steps of:

feeding fuel from a fuel tank by a prefeed pump to a high pressure pump disposed downstream from the prefeed pump, feeding the fuel into at least two injectors by said high pressure pump via a fuel distributor disposed downstream from the high-pressure pump, which is designed to distribute the fuel to the injectors, adjusting or limiting the pressure to be produced in the fuel distributor by a pressure control or pressure limiting valve disposed downstream from the high-pressure pump, determining a pressure downstream from the high-pressure pump and upstream from the pressure control or pressure limiting valve by a pressure sensor, wherein the pressure sensor, the pressure control or pressure limiting valve and the fuel distributor are formed in a high-pressure module, and the high-pressure module is formed as a structural unit with the high-pressure pump, and performing at least one step selected from the group consisting of:

determining a temperature of the fuel downstream from the high-pressure pump and upstream from the pressure control or pressure limiting valve by a temperature sensor formed in the high-pressure module, influencing downstream from the fuel distributor and upstream from the injectors in the high-pressure module using a first hydraulic resistance element, and feeding back part of the fuel fed by the high pressure pump into the fuel tank via a fuel accumulator formed in the high-pressure module, disposed downstream from the pressure control or pressure limiting valve, and hydraulically coupled to a leakage drain of the injectors.

5. The method according to claim 4, wherein an additional hydraulic resistance element is hydraulically disposed in the high-pressure module between the leakage drain and the fuel accumulator.

6. The method according to claim 4, wherein the high-pressure module is designed as a structural unit with the prefeed pump.

7. An injection system for an internal combustion engine, comprising:

a prefeed pump coupled with a fuel tank, a high-pressure pump disposed downstream from the prefeed pump, a fuel distributor disposed downstream from the high-pressure pump and coupled with at least two injectors, a pressure control or pressure limiting valve disposed downstream from the high-pressure pump, a pressure sensor for determining a pressure downstream from the high-pressure pump and upstream from the pressure control or pressure limiting valve, wherein the pressure sensor, the pressure control or pressure limiting valve and the fuel distributor are formed in a high-pressure module, and the high-pressure module is formed as a structural unit with the high-pressure pump, and at least one of:

(a) a temperature sensor formed in the high-pressure module for determining a temperature of the fuel downstream from the high-pressure pump and upstream from the pressure control or pressure limiting valve, (b) a first hydraulic resistance element disposed downstream from the fuel distributor and upstream from the injectors in the high-pressure module, and (c) a fuel accumulator formed in the high-pressure module is disposed downstream from the pressure control or pressure limiting valve, said fuel accumulator being hydraulically coupled to a leakage drain of the injectors.

8. The injection system as claimed in claim 7, wherein an additional hydraulic resistance element is hydraulically disposed in the high-pressure module between the leakage drain and the fuel accumulator.

9. The injection system as claimed in claim 7, wherein the high-pressure module is designed as a structural unit with the prefeed pump.

* * * * *